US005988794A

United States Patent [19]

Takagi

[11] Patent Number: 5,988,794

[45] **Date of Patent: *Nov. 23, 1999**

[54] APERTURE ELECTRODE ASSEMBLY FOR AN IMAGE FORMING DEVICE

[75] Inventor: Osamu Takagi, Nagoya, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/662,443

[22] Filed: Jun. 10, 1996

[30] Foreign Application Priority Data

| | | | |
|---|---|---|---|
| Jun. 9, 1995 | [JP] | Japan | 7-142867 |
| Jul. 24, 1995 | [JP] | Japan | 7-186888 |
| Jul. 28, 1995 | [JP] | Japan | 7-192970 |

[51] Int. Cl.[6] ..... B41J 2/06

[52] U.S. Cl. ..... 347/55

[58] Field of Search ..... 347/55, 112, 141, 347/149; 348/562, 634

[56] References Cited

U.S. PATENT DOCUMENTS

| | | | |
|---|---|---|---|
| 4,922,299 | 5/1990 | Uchimoto et al. | 399/168 |
| 4,963,886 | 10/1990 | Fukuda et al. | 347/209 |
| 4,972,205 | 11/1990 | Nagato | 347/200 |
| 5,036,341 | 7/1991 | Larsson | 347/55 |
| 5,640,185 | 6/1997 | Kagayama | 347/55 |
| 5,666,147 | 9/1997 | Larson | 347/55 X |

FOREIGN PATENT DOCUMENTS

| | | | |
|---|---|---|---|
| 0 587 366 A1 | 3/1994 | European Pat. Off. | 347/55 |

*Primary Examiner*—John Barlow
*Assistant Examiner*—C. Dickens
*Attorney, Agent, or Firm*—Oliff & Berridge, PLC

[57] ABSTRACT

An image forming device of the type using an aperture electrode assembly in which toner passage through apertures formed is controlled in accordance with a drive signal and the toner particles selectively pass through the apertures to form an image on a recording medium. The aperture electrode assembly includes an electrical insulation sheet and a plurality of control electrodes formed thereon. Wrinkles are prevented from occurring in the insulation sheet when the electrode assembly is secured to a frame or the wrinkles, even if generated resulting from mounting of driver IC chips on the insulation sheet, do not spread to the vicinity of the apertures.

18 Claims, 7 Drawing Sheets

APERTURE ELECTRODE ASSEMBLY FOR AN IMAGE FORMING DEVICE

BACKGROUND OF THE INVENTION

1. Field of the Invention

The present invention relates to an image forming device for use in a copying machine, printer, plotter, facsimile device, or the like. More particularly, the invention relates to an image forming device of the type using an aperture electrode assembly.

2. Description of the Related Art

European Patent Publication (A1) No. 587 366 (corresponding to Japanese Laid-Open Patent Publication No. Hei-6-155798) discloses an image forming device of the type using an aperture electrode assembly. The aperture electrode assembly is formed with a plurality of apertures therein and toner passage through the apertures is controlled in accordance with a drive signal applied to respective control electrodes connected to the apertures. The toner particles selectively pass through the apertures to form an image on an image recording medium.

More specifically, as shown in FIG. 1, the image forming device of the type described above includes a toner carrying roller 114 rotatably disposed in confrontation with an image recording medium 120 with an aperture electrode assembly 101 intervened therebetween. The toner carrying roller 114 has its own axis extending in the direction perpendicular to the surface of FIG. 1. The aperture electrode assembly 101 is disposed so that its longitudinal direction extends in the direction in parallel with the axis of the toner carrying roller 114. A back electrode roller 122 is rotatably disposed in a position opposite the toner carrying roller 114 with respect to the recording medium 120. The axis of the back electrode roller 122 is also in parallel with the axis of the toner carrying roller 114.

The aperture electrode assembly 101 includes a 25 $\mu$m thick electrical insulation sheet 102 made of polyimide. A plurality of apertures 106 are formed in the insulation sheet 102. Each aperture is 100 $\mu$m in diameter. The apertures 106 are aligned in the longitudinal direction of the aperture electrode assembly 101. The aperture electrode assembly 101 further includes control electrodes 104. The control electrodes 104 are provided in one-to-one correspondence to the apertures on the insulation sheet 102 so as to surround the respective ones of the apertures. The control electrode 104 is made of a copper foil of 1 $\mu$m thickness and has a width of 20 $\mu$m. The control electrodes formed surface of the aperture electrode assembly 101 faces the image recording medium 120.

A toner reservoir 111 storing toner therein is disposed below the aperture electrode assembly 101. A toner conveying roller 112 and the toner carrying roller 114 are rotatably disposed interiorly of the toner reservoir 111. Rotation of a toner conveying roller 112 conveys toner toward the toner carrying roller 114 and electrically charged toner particles are released toward the image recording medium 120 through the apertures 106.

The image forming device includes a data control circuit 108 for applying control voltages to the control electrodes 104 to control toner travels toward the recording medium 120 through the apertures 106. The control voltage corresponds to an image signal.

FIG. 2 shows one example of the aperture electrode assembly 101. As shown therein, a pair of supporting plates 107A and 107B are bonded to the surface opposite the control electrode formed surface of the insulation sheet 102. The supporting plates 107A and 107B are bonded along first and second lines on the insulation sheet 102, respectively. The first and second lines are in parallel with each other and also in parallel with an aperture line on which the apertures 106 align. The first line is at one side of the aperture line and the second line is at the opposite side of the aperture line. The supporting plates 107A and 107B bonded to the aperture electrode assembly 101 are fixedly secured to the toner reservoir 111.

If the supporting plates 107A and 107B are obliquely fixed to the insulation sheet 102 or the fixing positions are offset from the first and second lines, then the insulation sheet 102 wrinkles when the supporting plates 107A and 107B are secured to the toner reservoir 111 or internal stress of the insulation sheet 102 becomes non-uniform.

More specifically, although it is desirable that the two supporting plates 107A and 107B be fixed to the insulation sheet 102 so as to be separated by a uniform distance L along the entire length of the insulation sheet 102, the supporting plates 107A and 107B are actually fixed no in parallel with each other. Actually the insulation sheet 102 is bonded to the supporting plates 107A and 107B so that the distance between the two mounting plates 107A and 107B at one end of the insulation sheet 102 is longer by dL than that at the opposite end of the insulation sheet 102. When such an aperture electrode assembly 101 is fixed to the toner reservoir 111, tensile force will be imparted on the insulation sheet 102 in the direction perpendicular to the longitudinal direction of the supporting plates 107A and 107B. The tensile force elongates the insulation sheet 102 and generates internal stress inside the insulation sheet 102.

FIG. 4 is a graphical representation indicating a relationship between elongated length of the insulation sheet 102 and internal stress thereof. The solid line in FIG. 4 is for the insulation sheet 102 with the supporting plates bonded in correct positions. The internal stress becomes T when the insulation sheet 102 elongates S. The dotted line in FIG. 4 is for the insulation sheet 102 with the mounting plates bonded in shifted positions. The widened portion of the insulation sheet 102 is less elongated by dL than the correctly bonded insulation sheet and the internal stress is lower by TB than T. Thus, the tensile force on the insulation sheet 102 is not uniform in the longitudinal direction of the toner carrying roller 14. Accordingly, the insulation sheet 102 wrinkles and the insulation sheet 102 is imparted with non-uniform internal stress. The wrinkles on the insulated sheet 102 and the non-uniform internal stress will affect the behavior of the toner particles under the apertures so as to move irregularly. As a result, the toner image density in the longitudinal direction of the toner carrying roller 114 will not be uniform, and clogging of image may partially occur.

FIG. 3 shows clamping of the insulation sheet 102. The insulation sheet 102 are clamped at both edge portions with two pairs of supporting plates 107A, 107C and 107B, 107D. The lower supporting plates 107A and 107B are secured to the toner reservoir 111 by an adhesive or screws. In such a clamping method, when driver IC chips are bonded by an adhesive to the surface of the insulation sheet 102, the rigidity of the IC chip mounted portions becomes high when compared with that of other portions, so that the insulation sheet 102 wrinkles. As a result, the toner passing amount in the respective apertures becomes non-uniform, and so the print quality of the reproduced image is degraded caused by the density variation of the reproduced image and image distortions.

FIG. 5 shows another conventional aperture electrode assembly 101. Conventionally, no concern has been made as to the direction in which the control electrodes 104 extend on the insulated sheet 102. If the control electrodes 106 have an obliquely arranged pattern as shown in FIG. 5, the central portion of the insulation sheet 102 is concentrated with the control electrodes 104. Therefore, the central portion of the insulation sheet 102 is high in Young's modulus, so strong against tensile strength. On the other hand, side portions of the insulation sheet 102 where no control electrodes are formed is low in Young's modulus, so weak against tensile strength. Non-uniform tensile strength over the entire surface of the insulation sheet 102 results in wrinkles of the insulated sheet 102. Further, abutting force of the toner carrying roller 114 against the insulation sheet 102 will not be uniform. This problem is particularly noticeable when the driver IC chips 109 are mounted on the surface of the insulation sheet 102 as shown in FIG. 5 where the pitch of the control electrodes 104 is narrowed toward the IC chips 109. The driver IC chips 109 control voltages applied to the respective control electrodes 104, and it is advantageous to mount the IC chips 109 on the insulation sheet 102 to reduce the manufacturing cost.

SUMMARY OF THE INVENTION

The present invention has been made to solve the above-described problems; and accordingly it is an object of the present invention to provide an image forming device that is stably operable and also capable of reproducing high quality images free from density variation of the reproduced image and image distortions.

The image forming device of the present invention includes a frame, an electrode array or electrode member, and particle supplying means. The electrode array or electrode member includes a substrate formed with a plurality of apertures in alignment with one another on an aperture line, and a plurality of control electrodes provided to respective ones of the plurality of apertures individually. The particle supplying means supplies electrically charged particles to the plurality of apertures formed on the substrate of the electrode array. The image forming device of the present invention has attaching means for attaching the supporting means to a frame to thereby secure the electrode array to the frame, and wrinkle prevention means for preventing at least a portion of apertures in the electrode array from being wrinkled when the electrode array is secured to the frame by the attaching means. The wrinkle prevention means comprises internal stress dispersing means for substantially evenly dispersing internal stress yielded when the electrode array is secured to the frame by the attaching means. An example of the internal stress dispersing means is a resilient member fixedly attached to at least one side of the substrate. Alternatively, the wrinkle prevention means comprises blocking means for blocking wrinkles from spreading to the portion of apertures.

According to one aspect of the present invention, a resilient member is fixedly attached at least to the first side of the substrate to be integral with the electrode array. The electrode array has a first side in parallel with the aperture line, and a second side also in parallel with the aperture line. Supporting means is provided for supporting the electrode array along a first line and a second line in parallel with each other and also in parallel with the aperture line. The first line is on the electrode array and the second line is on the resilient member.

According to another aspect of the present invention, at least one driver IC chip is mounted on the substrate and connected to the plurality of control electrodes for controlling the plurality of control electrodes independently of one another so that the electrically charged particles selectively travel from the particle supplying means toward an image recording medium while passing through the plurality of apertures. First supporting means is provided for supporting the electrode array and securing the electrode array to the frame. The first supporting means urges the substrate along a first line between the driver IC chip and the aperture line in which the first line extends in a direction in parallel with the aperture line. There is also provided second supporting means for supporting the electrode array and securing the electrode array to the frame. The second supporting means supports the electrode array along a second line opposite the first line with respect to the aperture line.

According to still another aspect of the present invention, the supporting means supports the electrode array along a first line and a second line in parallel with each other and also in parallel with the aperture line. The first line is opposite to the second line with respect to the aperture line. Each of the plurality of control electrodes extend perpendicular to the aperture line in an inner region between the first line and the second line and at least one of the plurality of control electrodes is bent in an outer region outside the inner region.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 1:
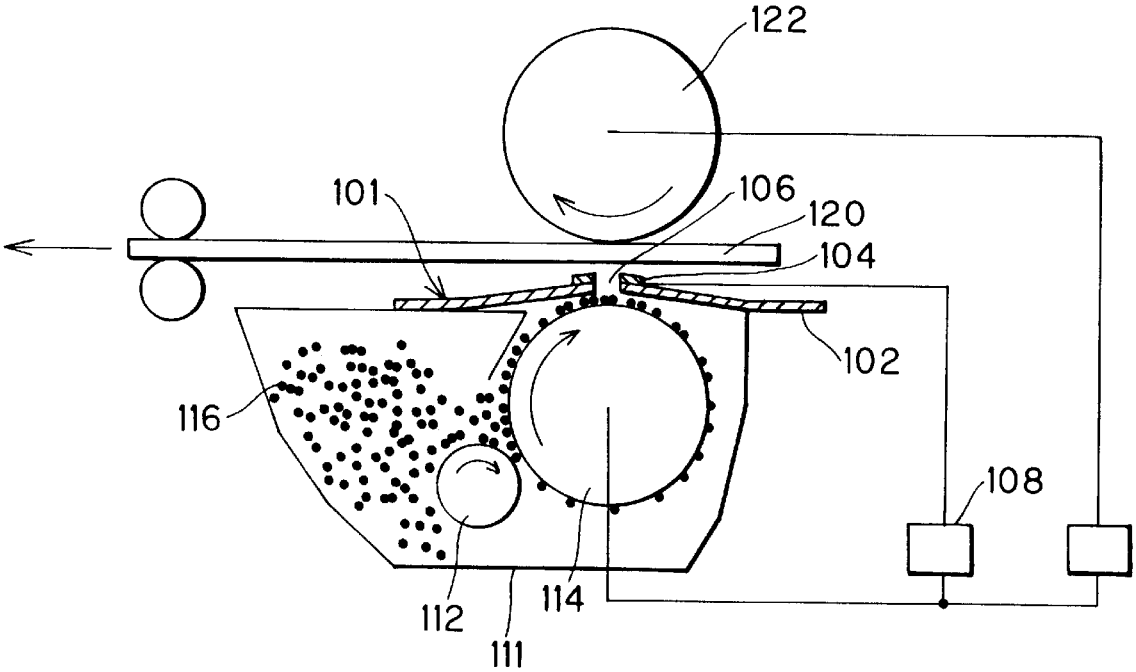
FIG. 1 PRIOR ART
FIG. 1 is a cross-sectional view showing a conventional image forming device.
Figure 2:
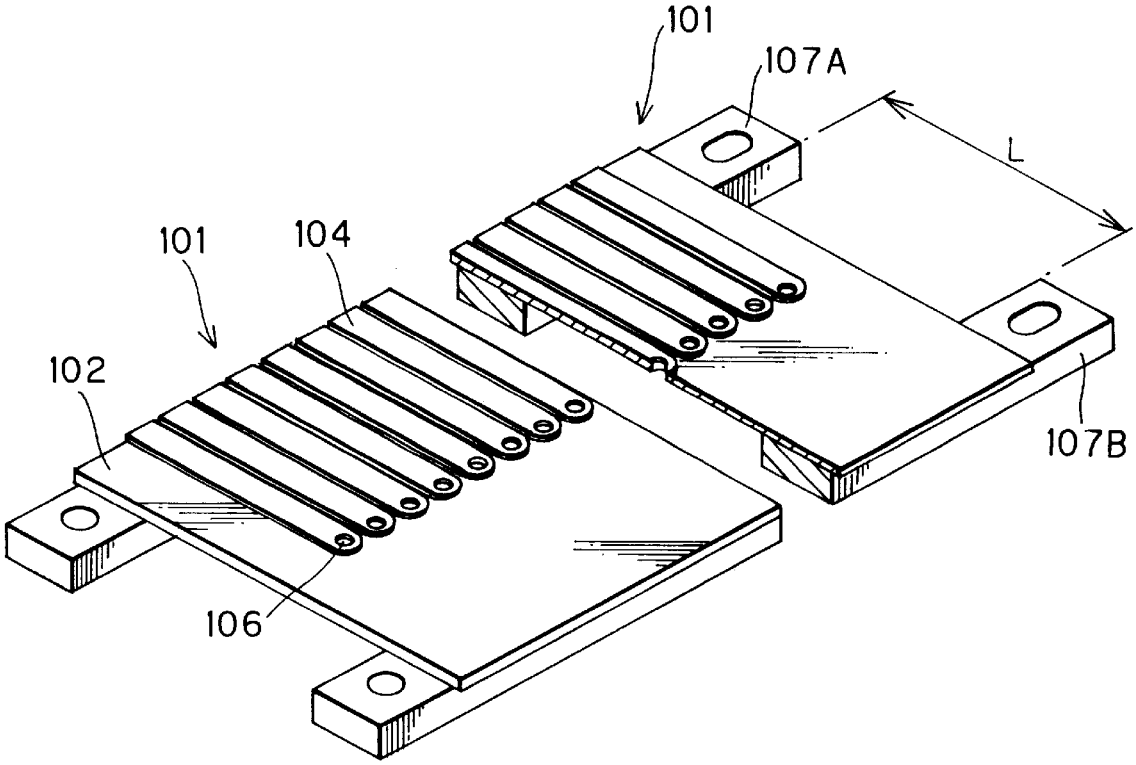
FIG. 2 PRIOR ART
FIG. 2 is a perspective view showing one example of an aperture electrode assembly incorporated in the image forming device shown in FIG. 1.
Figure 3:
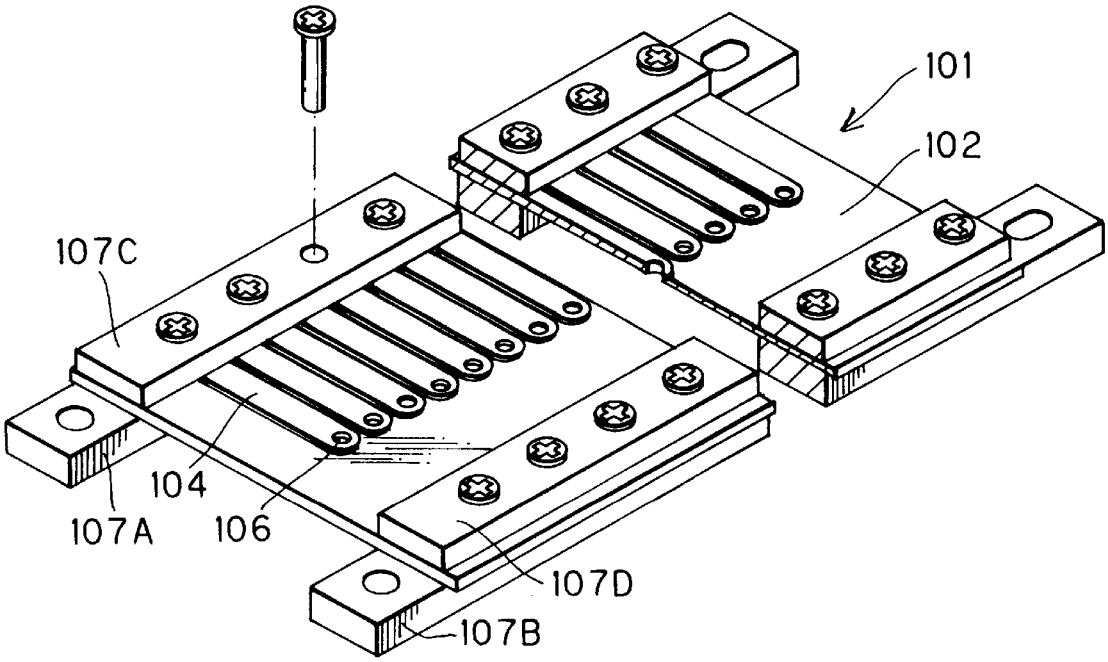
FIG. 3 PRIOR ART
FIG. 3 is a perspective view illustrating fabricating procedure of the aperture electrode assembly shown in FIG. 2.

Preferred embodiments of the present invention will be described with reference to the accompanying drawings. The expressions "above", "below", "upper" and "lower" are used throughout the description to define various parts when the image forming device is disposed in an orientation in which it is intended to be used.

The image forming device 50 includes a toner supplying unit 10, an aperture electrode assembly 1, a back electrode plate 22, and a fixing unit 26. The aperture electrode assembly 1 controls a toner stream and is sandwiched between the back electrode plate 22 and the toner supplying unit 10 so as to be separated from the back electrode plate 22 by a distance of 1 mm. An image recording medium 20 passes by a toner image forming station. That is, the recording medium 20 is inserted into the space between the aperture electrode assembly 1 and the back electrode plate 22, and is transported in the direction indicated by an arrow C by virtue of feed rollers 19 rotating in the direction indicated by an arrow D. The fixing unit 26 is provided for thermally fixing the toner image formed on the image recording medium 20, and is therefore disposed downstream of the toner image forming station in the transportation direction of the recording medium 20. The fixing unit 26 is composed of a pressure roller 26*a* and a heat roller 26*b*. The pressure roller 26*a* is formed with silicon rubber on its outer periphery. A halogen heater is provided interiorly of the heat roller 26*b*.

The toner supplying unit 10 includes a toner reservoir 11 storing toner particles 16 therein and also serving as a frame for the aperture electrode assembly 1. A toner carrying roller 14 is rotatably provided interiorly of the toner reservoir 11 for conveying the toner particles 16 toward the aperture electrode assembly 1. The toner carrying roller 14 rotates in the direction indicated by an arrow B. A toner conveying roller 12 is disposed adjacent the toner carrying roller 14 for supplying the toner particles 16 onto the outer peripheral surface of the toner carrying roller 14. Both the toner carrying roller 14 and the toner conveying roller 12 have their own axes extending in a direction perpendicular to the surface of FIG. 1. The axes of the two rollers 12 and 14 are in parallel with each other and diagonal lines of these rollers are in contact with each other. A toner agitator is disposed adjacent the toner conveying roller 12 for agitating and conveying the toner toward the toner conveying roller 12. A toner regulating blade 18 is provided above the toner carrying roller 14 for regulating the amount of toner on the peripheral surface of the toner carrying roller 14 and also for uniformly charging the toner particles 16.

Figure 6:
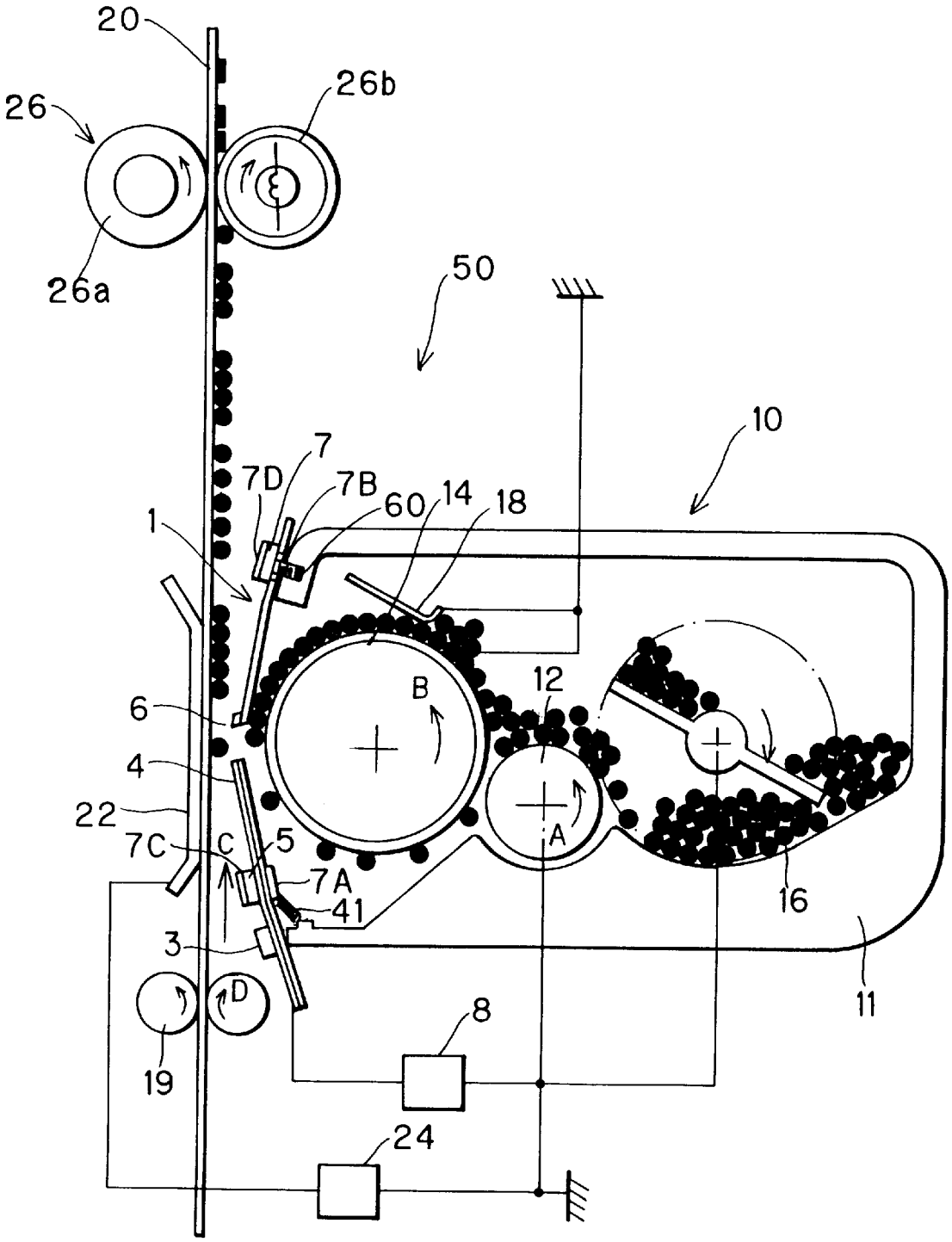
FIG. 6 is a cross-sectional view showing an image forming device according to the present invention.
Figure 7:
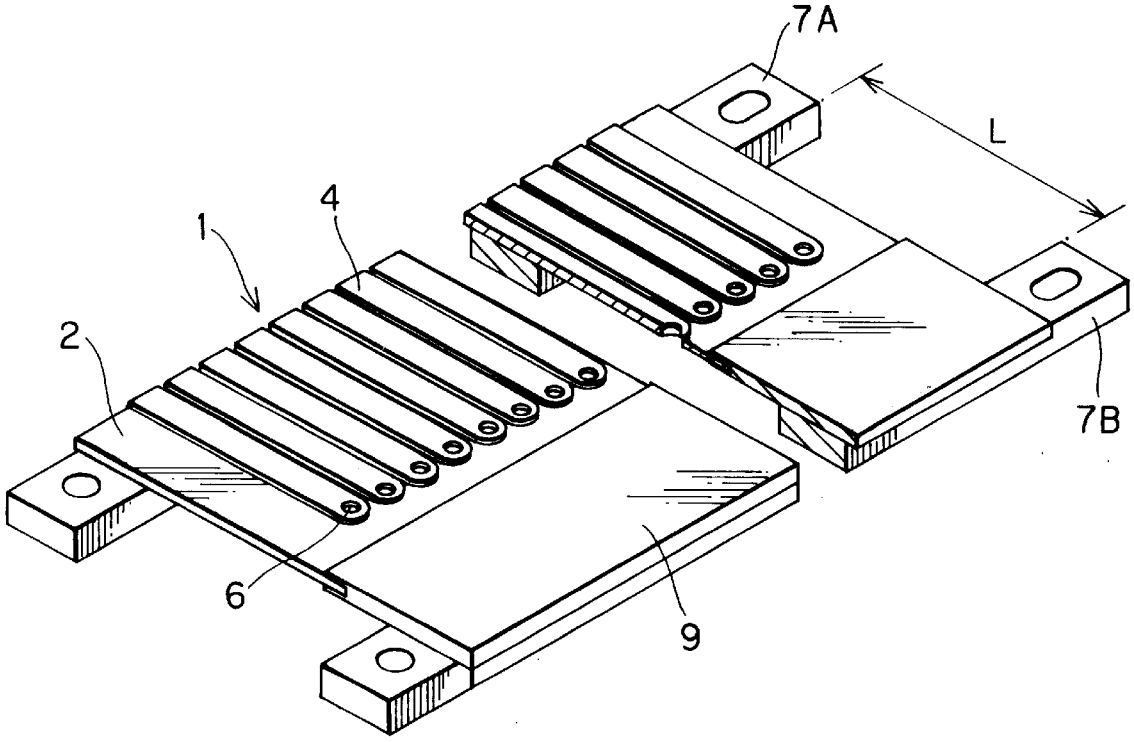
FIG. 7 is a perspective view showing an aperture electrode assembly for use in the image forming device shown in FIG. 6 according to a first embodiment of the present invention.

FIG. 7 shows a first embodiment of the aperture electrode assembly to be used in the image forming device 50 shown in FIG. 6. The aperture electrode assembly 1 includes an electrical insulation sheet 2 made from polyimide of 25 $\mu$m thickness. The insulation sheet 2 is of a rectangular shape having first and second longitudinal sides. A plurality of apertures 6 are formed in the insulation sheet 2 in alignment with one another on a straight line which will hereinafter referred to as "aperture line". The aperture line extends in parallel with the first and second longitudinal sides of the insulation sheet 2. Each aperture 6 is 60 $\mu$m in diameter. A plurality of control electrodes 4 are formed on the insulation sheet 2 in one-to-one correspondence to the plurality of apertures 6. The control electrodes 4 extend from the first longitudinal side of the insulation sheet 2 toward the apertures 6. The direction in which the control electrodes 4 extend is perpendicular to the aperture line. The tip ends of the control electrodes 4 are rounded and formed with apertures 6 therein. The apertures 6 of the control electrodes 4 have the same diameter as those formed in the insulation sheet 2 and are in an overlapped relation with those formed in the insulation sheet 2. The control electrode 4 is formed from a copper foil having a thickness of 8 $\mu$m.

A rubber plate 9 is bonded to the second longitudinal side of the insulation sheet 2 using an adhesive. The rubber plate 9 has a uniform thickness of 1 mm thicker than the thickness (8 $\mu$m) of the control electrode 4. The rubber plate 9 has a rectangular shape having a longitudinal side to dimensionally match the longitudinal side of the insulation sheet 2. The rubber plate 9 is closely positioned to the apertures 6. That is, the second longitudinal side of the insulation sheet 2 to which the rubber plate 9 is bonded is closer to the aperture line than the first longitudinal side of the insulation sheet 2.

The rubber plate bonded insulation sheet 2 is supported by a pair of elongated supporting plates 7A and 7B that are bonded to the surface opposite the control electrodes formed surface. The supporting plate 7A is bonded to the longitudinal edge portion of the insulation sheet 2 and the supporting plate 7B to the rubber plate 9. The supporting plates 7A and 7B are disposed in parallel with each other and separated by a distance L. The supporting plates 7A and 7B are fixedly secured to the toner reservoir 11 so that the rubber plate 9 elongates a predetermined length.

Figure 4:
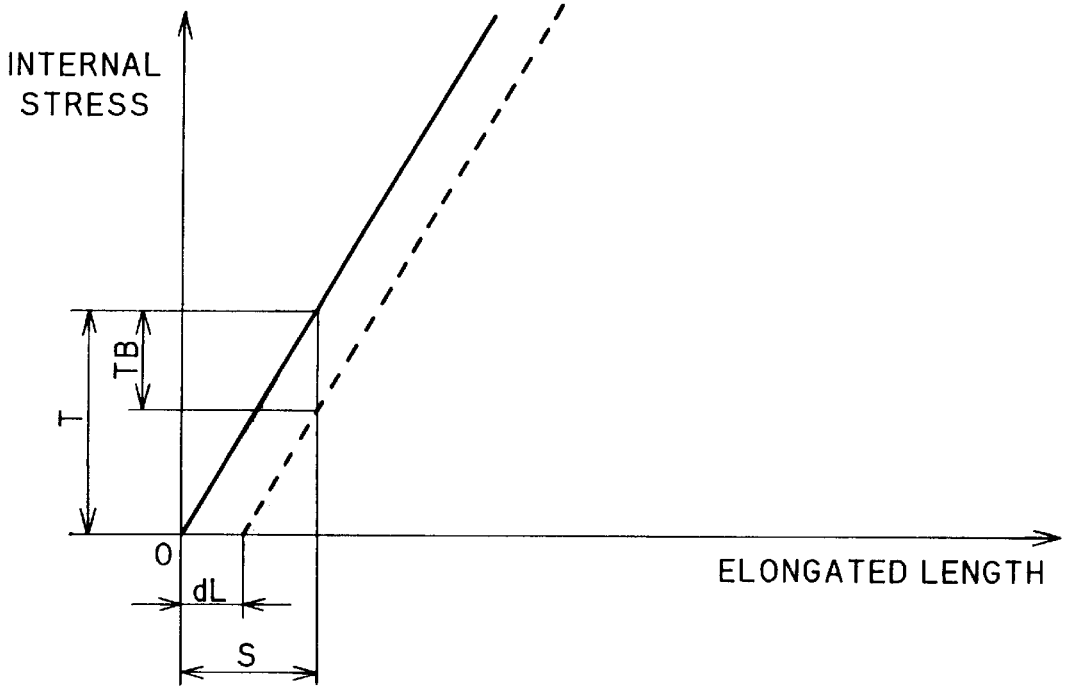
FIG. 4 PRIOR ART
FIG. 4 is a graphical representation showing a relationship between elongated length and internal stress of the substrate of the aperture electrode assembly shown in FIG. 2.
Figure 5:
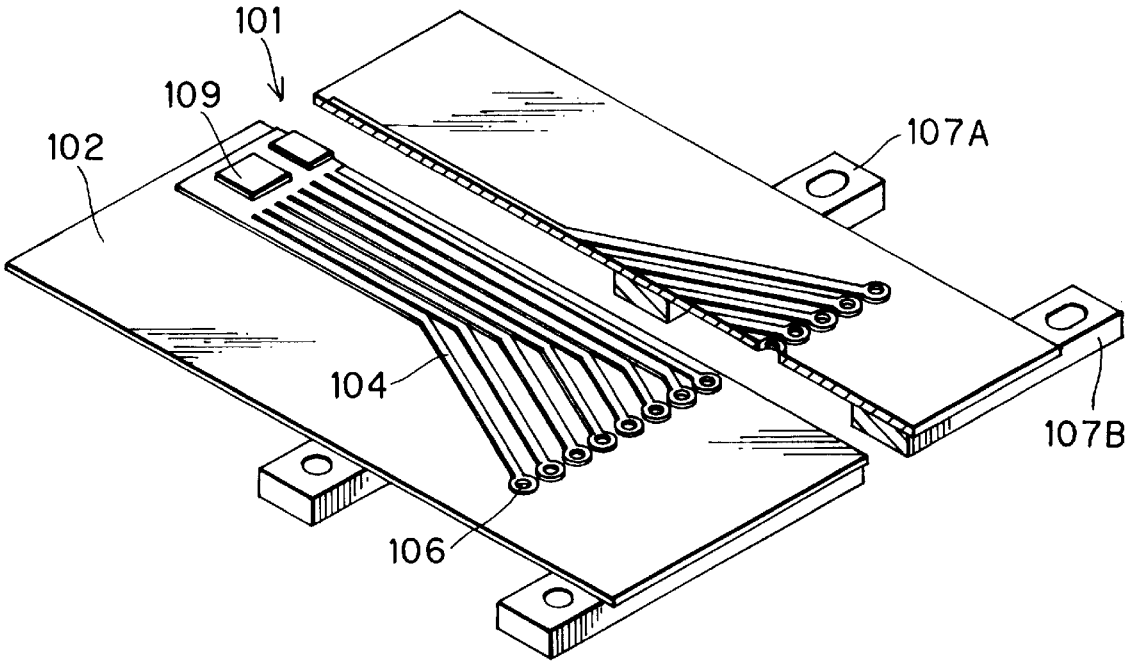
FIG. 5 PRIOR ART
FIG. 5 is a perspective view showing another example of an aperture electrode assembly incorporated in the image forming device shown in FIG. 1.
Figure 9:
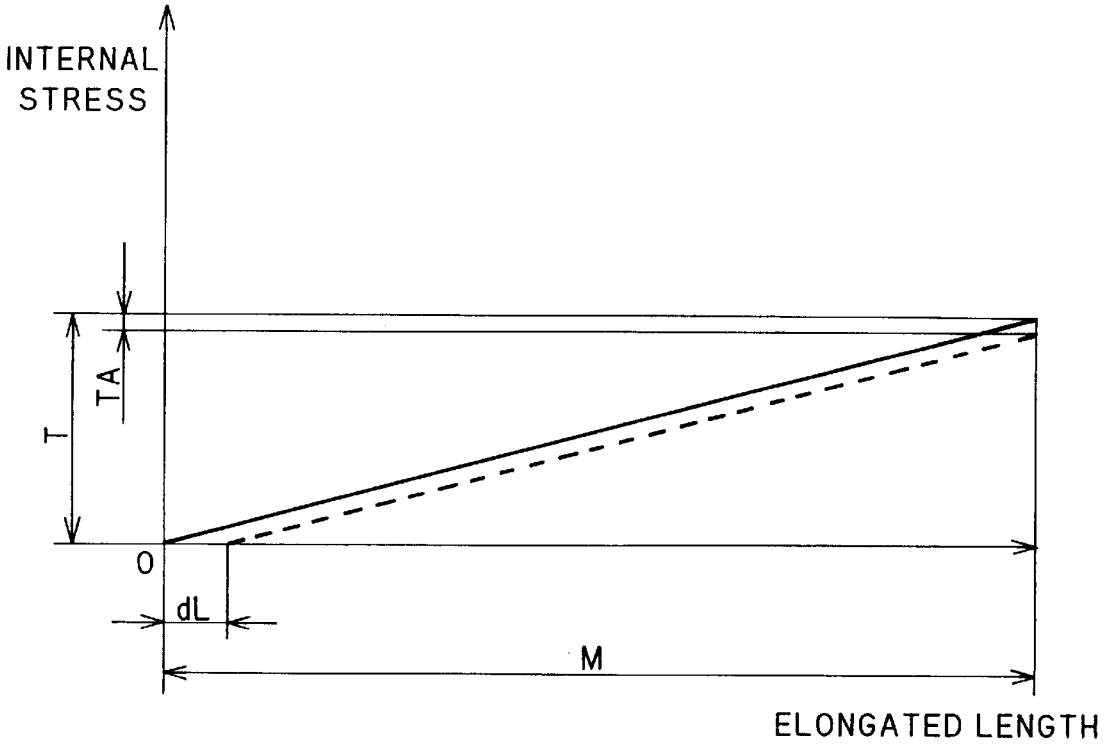
FIG. 9 is graphical representation showing a relationship between elongated length and internal stress of the substrate of the aperture electrode assembly shown in FIG. 7.

FIG. 9 shows a relationship between the elongated length of the aperture electrode assembly 1 and an internal stress therein caused by the elongation. As can be seen in FIG. 9, the gradient of the internal stress per an elongated length is small as compared with the graph shown in FIG. 4. By the provision of the rubber plate 9, the difference in internal stress yielded in the insulation sheet 2 is negligibly small between the loosely stretched portion of the insulation sheet 2 and the tightly stretched portion of the insulation sheet 2. If the supporting plates 7A and 7B are secured to the toner reservoir 11 by increasing the distance therebetween by M, the internal stress of the insulation sheet 2 becomes T as shown by a solid line in FIG. 9. In such a condition, a loosely attached portion of the insulation sheet 2 is less elongated by a loosened length dL and the internal stress decreases by TA as shown by the dotted line in FIG. 9. Because the gradient of the elongated length vs. internal stress curve is small, the difference of the internal stress TA is negligibly small. Accordingly, even if the insulation sheet 2 is partially loosely attached to the supporting plates 7A and 7B, the insulation sheet 2 would not wrinkle and so the image quality would not be degraded caused by the non-uniform stretching of the insulation sheet 2 to the supporting plates 7A and 7B.

In the above-described embodiment, the rubber plate 9 is bonded to the second longitudinal side of the insulation sheet 2, however, it can be bonded to the first longitudinal side thereof from which the control electrodes 4 extend. Further, regardless of which portion the rubber plate 9 is bonded, the rubber plate 9 can be directly secured to the toner reservoir 11. Alternatively, the supporting plates 7A and 7B can be secured to the toner reservoir 11 via coil springs.

Figure 10:
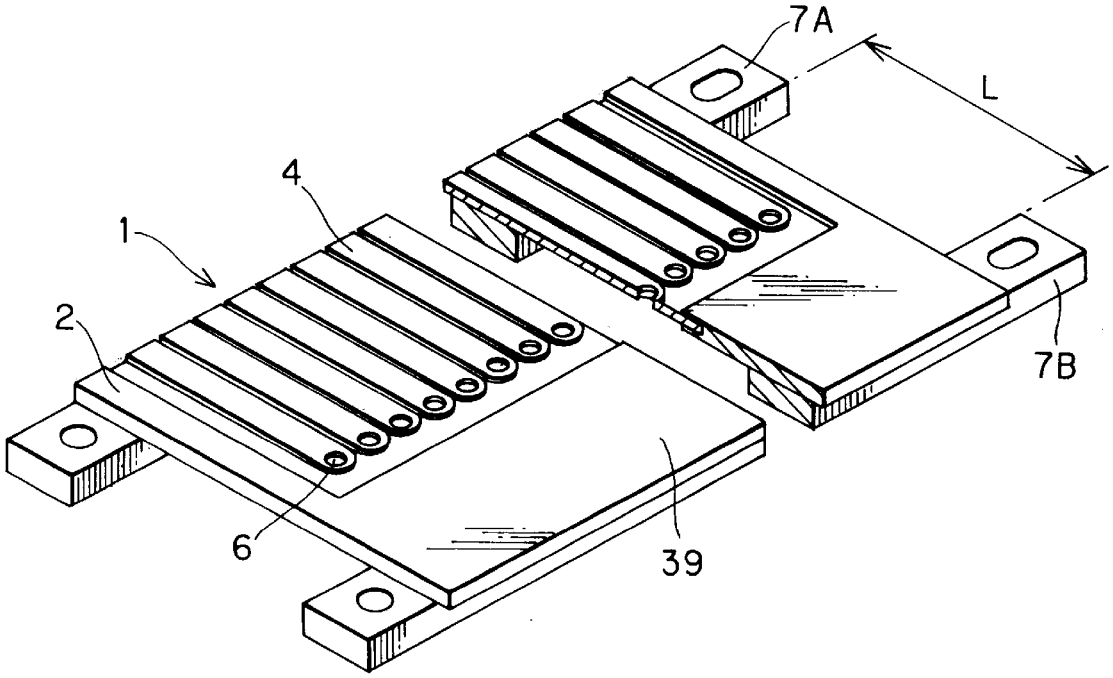
FIG. 10 is a perspective view showing a modification of the aperture electrode assembly shown in FIG. 7.

FIG. 10 is a modification of the embodiment shown in FIG. 7. The modification uses a U-shaped rubber plate 39 which is bonded to the insulation sheet 2 to surround three sides of the insulation sheet 2 except the longitudinal side thereof from which the control electrodes 4 extend. The rubber plate bonded aperture electrode assembly is fixed to the supporting plates 7A and 7B while imparting tensile force to the rubber plate 39 in the direction in which the control electrodes 4 extend. By so doing, generation of wrinkles in the insulation sheet 2 can be prevented and the internal stress in the insulation sheet 2 can be made substantially uniform.

Another modification is possible in which the insulation sheet 2 may be directly bonded to the supporting plates 7A and 7B using an adhesive which exhibits a rubber-like elasticity when dried. Alternatively, the insulation sheet 2 may be formed with a material which exhibits rubber-like elasticity. Such materials includes urethan rubber, silicon rubber, CR, NBR. With the insulation sheet formed from such a material, the shape of the aperture may slightly deform when the sheet is bonded to the supporting plates 7A and 7B. Therefore, the shape of aperture needs to be determined when the apertures are formed while taking into consideration the deformation of the apertures at the time of bonding to the supporting plates 7A and 7B.

Figure 11:
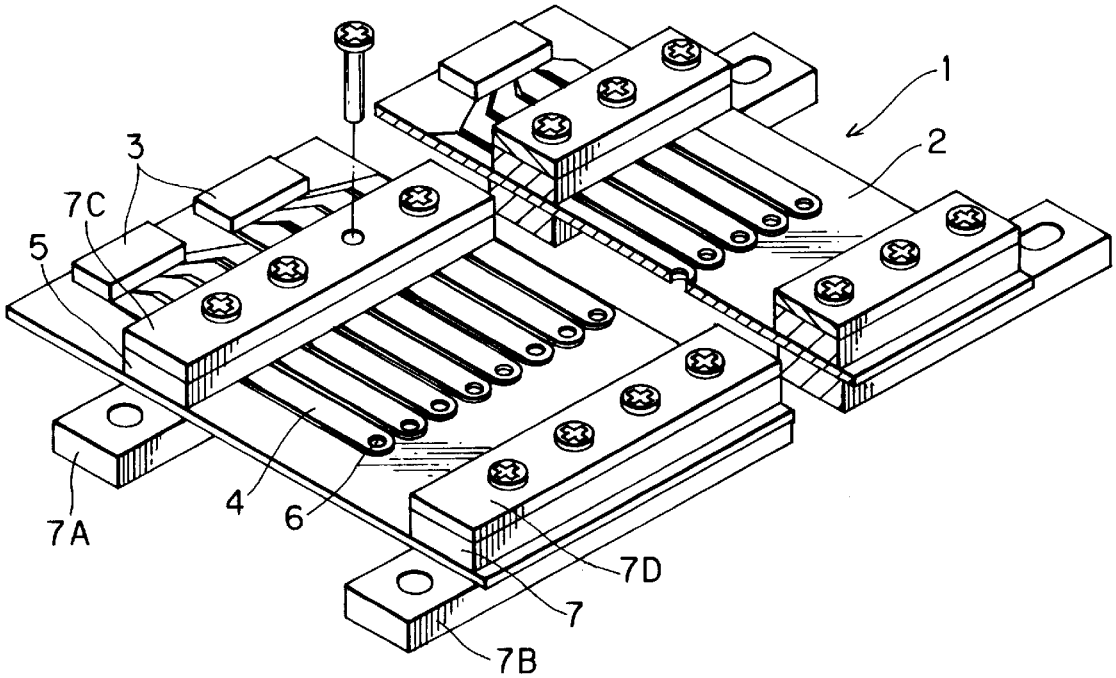
FIG. 11 is a perspective view showing an aperture electrode assembly for use in the image forming device shown in FIG. 6 according to a second embodiment of the present invention.

FIG. 11 shows a second embodiment of the aperture electrode assembly 1 to be used in the image forming device 50 shown in FIG. 6. The aperture electrode assembly 1 of the second embodiment differs from that of the first embodiment in that a plurality of driver IC chips 3 are mounted on the insulation sheet 2. The driver IC chips 3 are bonded by an adhesive to the same surface of the insulation sheet 2 on which the control electrodes 4 are formed. Each driver IC chip has several output terminals connected to the control electrodes 4.

As shown in FIG. 11, a downstream side lower supporting plate 7A and an upstream side lower supporting plate 7B are placed at the opposite side of the control electrode formed surface, and a downstream side upper supporting plate 7C and an upstream side upper supporting plate 7D are placed at the side of the control electrode formed surface. The downstream side supporting plates 7C and 7A are located between the aperture line and the line on which the driver IC chips 3 are arranged. The upstream side supporting plates 7C and 7D are located at the edge portion of the insulation sheet 2 opposite the side where the driver IC chips 3 are arranged. The downstream side upper supporting plate 7C is placed in an overlapped relation with the downstream side lower supporting plate 7A. Likewise, the upstream side upper supporting plate 7D is placed in an overlapped relation with the upstream side lower supporting plate 7B. The downstream and upstream side supporting plates are arranged in parallel with one another.

The downstream side upper and lower supporting plates 7C and 7A sandwich an urethan rubber (elastic material) 5 and the insulation sheet 2. Likewise, the upstream side upper and lower supporting plates 7D and 7B sandwich an urethan rubber 7 and the insulation sheet 2. In this condition, the upper and lower supporting plates are fastened with screws as shown in FIG. 11. In this manner, the insulation sheet 2 is clamped in one portion by the urethan rubber 5 and supporting plates 7C and 7A at the position between the line of driver IC chips 3 and the aperture line. Therefore, the wrinkles generated at the time of bonding the driver IC chips 3 on the surface of the insulation sheet 2 can be prevented from spreading to the vicinity of the apertures 6. Further, the control electrodes 4 do not directly contact the upper supporting plates 7C and 7D that are made of a rigid material but contact the urethan rubbers 5 and 7. Therefore, the control electrodes 4 will not be scratched and disconnected. Because the urethan rubbers 5 and 7 distribute the screw tightening force to all over the surface, the portions around the screws and between screws are clamped with substantially uniform force. The upstream side lower supporting plate 7B is fixedly secured to the toner reservoir 11 as shown in FIG. 6. The downstream side lower supporting plate 7A is attached to the toner reservoir 11 via expansion spring 41. When the aperture electrode assembly 1 is secured to the toner reservoir 11, the insulation sheet 2 is brought into abutment with the toner carrying roller 14, resulting in generation of tensile force in the insulation sheet 2. However, because uniform clamping force is imparted on the insulation sheet 2, the tensile force generated is made uniform. The contact pressure between the apertures 6 and the toner carrying roller 14 is also uniform if the tensile force is uniform. Therefore, there would be no density variation in the reproduced image.

In the above-described second embodiment, although the urethan rubbers are used, other elastic materials can be used instead, such as rubber elastic material, silicon, resin or the like.

Figure 12:
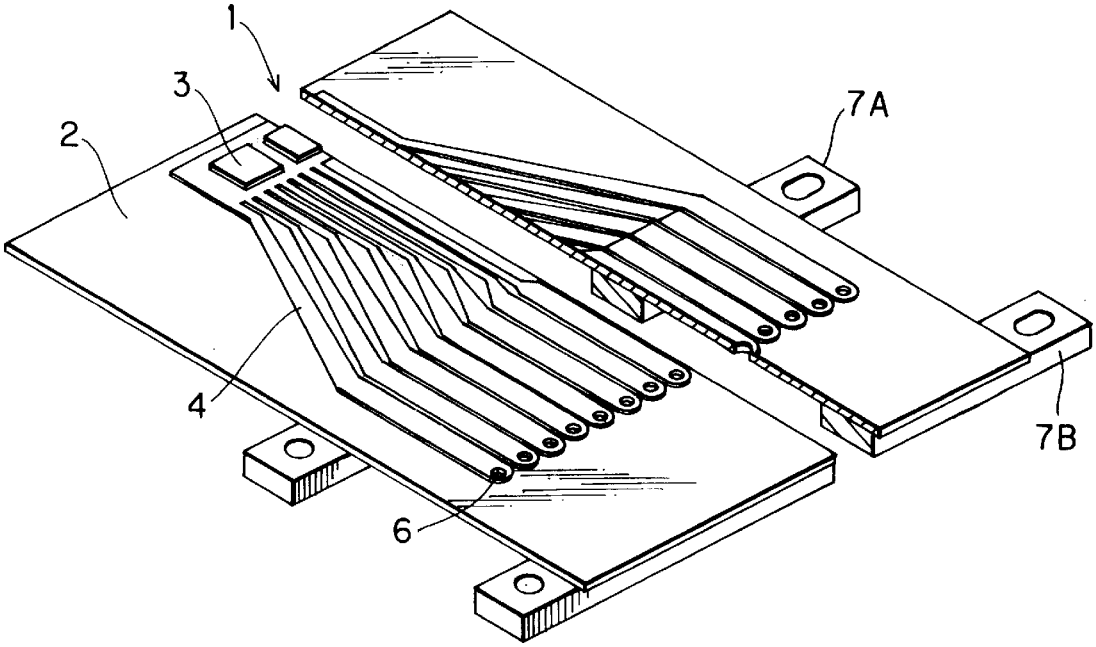
FIG. 12 is a perspective view showing an aperture electrode assembly for use in the image forming device shown in FIG. 6 according to a third embodiment of the present invention.

FIG. 12 shows a third embodiment of the aperture electrode assembly 1 to be used in the image forming device 50 shown in FIG. 6. The aperture electrode assembly 1 of the third embodiment is similar to that of the second embodiment but differs therefrom in the pattern of the control electrodes 4.

Elongated supporting plates 7A and 7B are bonded with an adhesive to the lower surface of the insulation sheet 2. The longitudinal direction of the supporting plates 7A and 7B extends in parallel to the straight line on which the apertures 6 are aligned. The supporting plate 7A is bonded to a generally central portion of the insulation sheet 2 and the supporting plate 7B is bonded to the edge portion of the insulation sheet 2 opposite the driver IC chips formed edge portion.

The line on which the driver IC chips 3 are mounted is at one side of the supporting plate 7A and the aperture line is at the opposite side thereof. In the portion between the aperture line and the supporting plate 7A, the control electrodes 4 extend in parallel with one another and orthogonal to the aperture line. The remaining portions of the control electrodes 4 are bent inwardly to focus on the IC chips 3.

The aperture electrode assembly 1 is fixedly secured to the toner reservoir 11 by fixing the supporting plate 7B to the toner reservoir 11 by screws 60 (FIG. 6), and the supporting plate 7A via a tension spring 41 as shown in FIG. 6. When the fixed aperture electrode assembly 1 is held in pressure contact with the toner carrying roller 14, the aperture electrode assembly 1 will not wrinkle because the control electrodes 4 extend in parallel with one another between the supporting plates 7A and 7B. Further, the tensile force imparted on the aperture electrode assembly 1 is substantially uniform because the portion of the aperture electrode assembly 1 between the supporting plates 7A and 7B is uniformly rigid. Even if wrinkles were to form in the portion of the aperture electrode assembly 1 where the control electrodes 4 focus onto the driver IC chips 3, the wrinkles will not spread to the apertures 6. The driver IC chips 3 can be mounted on the central portion of the insulation sheet 2 because the directions in which the control electrodes 4 extend toward the IC chips 3 can be determined as desired. Further, because the supporting plate 7A is pulled by the tension spring 41, occurrence of wrinkles in the portion of the aperture electrode assembly 1 between the supporting plates 7A and 7B is suppressed.

Figure 8:
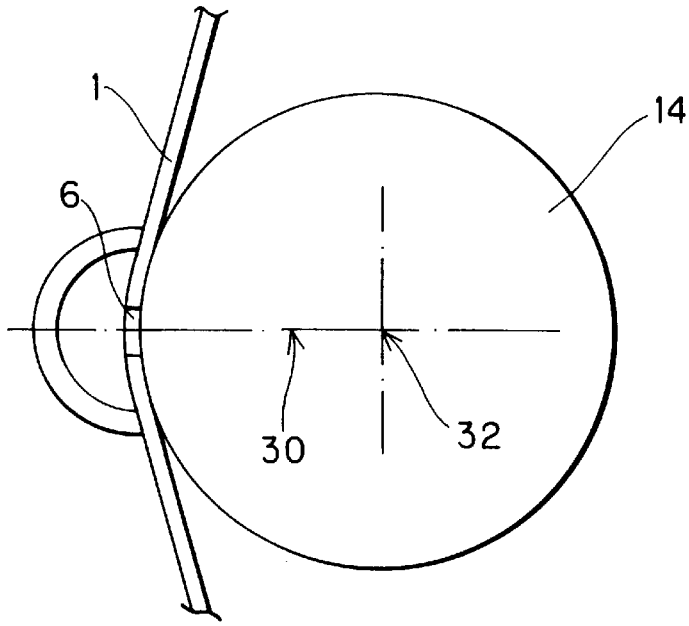
FIG. 8 is a cross-sectional view showing a relationship between the aperture electrode assembly and a toner carrying roller incorporated in the image forming device shown in FIG. 6.

Next, a positional relationship between the apertures 6 formed in the aperture electrode assembly 1 according to the various embodiments described and the toner carrying roller 14 will be described while referring to FIG. 8. As shown in FIG. 8, the toner carrying roller 14 is positioned so that the central line 30 of each aperture 6 intersects with the axis 32 of the toner carrying roller 14. That is, the aperture 6 and the peripheral surface of the roller 14 are symmetrical with respect to the central line 30 of the aperture 6. Therefore, the toner particles passing through the aperture 6 are uniformly distributed in the aperture 6. Because the inner surface of the aperture 6 is in parallel with the direction in which toner travels, toner travel is stable. The toner carrying roller 14 is urged toward the aperture electrode assembly 1 so that the upper half and the lower half of the aperture electrode assembly 1 deform symmetrically. As such, the contacting area between the toner carrying roller 14 and the aperture electrode assembly 1 is increased and the toner carrying roller 14 uniformly contacts the aperture. Therefore, toner is deposited at a constant density without variation.

As shown in FIG. 6, the data control circuit 8 is connected between the control electrode 4 and the toner carrying roller 14. The circuit 8 supplies −30 volts or +30 volts to the control electrode 4 via the driver IC chip 3 based on an image signal fed from an image signal receiving means (not shown) connected to any one of an external computer, an image reading device, or an image communication device.

A back voltage supplying circuit 24 is connected between the back electrode 22 and the toner carrying roller 14. The back voltage supplying circuit 24 supplies +1 kilovolts to the back electrode 22.

Operation of the image forming device shown in FIG. 6 will be described.

Rotation of the supply roller 12 in the direction indicated by the arrow A conveys the toner 16 stored in the toner reservoir 11 toward the toner carrying roller 14. The toner is scraped off the toner supply roller 12 onto the toner carrying roller 14 and negatively charged toner is held on the peripheral surface of the toner carrying roller 14. The toner attached to the peripheral surface of the toner carrying roller 14 is regulated by the toner regulation blade 18 to become a uniform thickness and the resultant toner layer is uniformly charged. The toner is then conveyed toward the aperture electrode assembly 1 in accordance with rotation of the toner carrying roller 14 rotating in the direction of B. The toner is scraped off the toner carrying roller 14 onto the insulation sheet 2 of the aperture electrode assembly 1.

Next, image forming operation will be described.

The data control circuit 8 selectively applies +30 volts to the control electrodes 4 in accordance with the image signal fed from the image signal reception means (not shown). Due to a voltage difference between the control electrode 4 and the toner carrying roller 14, lines of electric force extending from the control electrode 4 to the toner carrying roller 14 are formed in the apertures of the control electrodes 4 to which the +30 volts voltage is applied. Electrostatic force is imparted on the negatively charged toner particles to move them in the direction of a higher potential, so that the toner is released from the toner carrying roller 14 and passes through the apertures 6 of the control electrode 4. Because the back voltage supplying circuit 24 applies a +1 kilovolts voltage to the back electrode 22, an electric field is formed between the aperture electrode assembly 1 and the image recording medium 20 held on the back electrode 22. By the electric field formed therebetween, the toner particles move toward the image recording medium 20 and form picture elements thereon.

On the other hand, the data control circuit 8 selectively applies a −30 volts voltage to the control electrodes 4 so as not to form electric fields between the toner carrying roller 14 and the control electrodes 4. Because no electrostatic force is imparted on the toner particles 16 held on the peripheral surface of the toner carrying roller 14, the toner does not pass through the apertures 6 and accordingly no picture elements are formed on the image recording medium 20 in portions confronting the corresponding control electrodes 4.

When one row of picture elements is formed on the surface of the image recording medium 20, the latter is transported in the direction perpendicular to the line of apertures 6 by a transportation mechanism (not shown) by an amount corresponding to one row of picture elements. In this manner, by repeating the formation of the picture elements and transportation of the recording medium 20, a toner image is formed on the entire surface of the recording medium 20. As described, because the aperture electrode assembly 1 does not wrinkle and the abutting force between the aperture electrode assembly 1 and the toner carrying roller 14 is substantially uniform, the positions of the apertures do not shift. Accordingly, the reproduced image is free from density variation and clogging.

The image recording medium 20 carrying the toner image is transported to the fixing device 26 where the toner image is thermally fixed to the recording medium 20. The fixing device 26 may fix the toner image by applying pressure to the toner image carrying recording medium instead of thermally fixing the toner image.

In the image forming device 50, the insulation sheet 2 of the aperture electrode assembly 1 faces the toner carrying roller 14, so that the control electrodes 4 and the bear toner carrying roller 14 are not brought into direct contact with each other and thus the control electrodes are not short-circuited. There may be cases where the device operates where no toner is attracted to the peripheral surface of the toner carrying roller 14. For some reasons, no toner may be accumulated on the surface of the toner carrying roller 14. Accordingly, the data control circuit 8 is not damaged resulting from the short-circuiting of the control electrodes with the toner carrying roller 14.

While exemplary embodiments of this invention have been described in detail, those skilled in the art will recognize that there are many possible modifications and variations which may be made in these exemplary embodiments while yet retaining many of the novel features and advantages of the invention. For example, a lattice-shaped matrix electrode assembly as disclosed in U.S. Pat. No. 5,036,341 to Larsson can be used in lieu of the aperture electrode assembly.

What is claimed is:

1. An image forming device, comprising:

a frame;

an electrode member including a substrate formed with a plurality of apertures in alignment with one another to define an aperture line, and a plurality of control electrodes with each control electrode provided to a respective aperture wherein said substrate has a first side in parallel with the aperture line, a second side also in parallel with the aperture line, and a thickness, said substrate having a first mounting line extending in parallel with the aperture line;

a resilient member fixedly and directly attached to an entire length of the first side of said substrate to be integral with said electrode member, said resilient member having a second mounting line extending in parallel with the aperture line and the first mounting line;

particle supplying means for supplying electrically charged particles to the plurality of apertures formed on said substrate of said electrode member; and supporting means for supporting said electrode member and said resilient member along the first mounting line and the second mounting line, respectively;

wherein said resilient member accommodates variation in internal stress of said substrate generated when said resilient member is attached to said substrate, thereby preventing said electrode member from being wrinkled.

2. An image forming device according to claim 1, wherein said supporting means is secured to said frame with said first mounting line and said second mounting line being in a widened condition so that tensile force is generated in said substrate.

3. An image forming device according to claim 2, wherein said resilient member has a thickness thicker than the thickness of said electrode member.

4. An image forming device according to claim 2, wherein said substrate has a pair of oppositely disposed side edges, each side edge extending perpendicularly to the first side, and said resilient member is fixedly and directly attached to the first side and the pair of side edges of said substrate.

5. An image forming device according to claim 2, wherein a first distance between said resilient member and the aperture line is shorter than a second distance between the aperture line and the second side of said electrode member.

6. An image forming device according to claim 1, wherein said resilient member is fixedly attached to only the first side of said substrate, and wherein said plurality of control electrodes extend from the apertures to the second side of said substrate.

7. An image forming device according to claim 1, wherein said substrate is made of an electrically insulated material.

8. An image forming device according to claim 1, wherein said resilient member is made from rubber.

9. An image forming device according to claim 1, wherein said resilient member is in a form of a single piece of the plate-like resilient member.

10. An image forming device for forming an image on an image recording medium, comprising:

a frame;

an electrode member including a substrate formed with a plurality of apertures in alignment with one another to define an aperture line, the substrate having a first surface and a second surface opposite the first surface, and a plurality of control electrodes with each control electrode provided to a respective aperture on the first surface of said substrate wherein said substrate has a first side in parallel with the aperture line, a second side also in parallel with the aperture line, and a thickness, the substrate having a first mounting line extending parallel with the aperture line between the first side and the aperture line and a second mounting line extending parallel with the aperture line and the first mounting line between the second side and the aperture line, the aperture line being positioned between the first mounting line and the second mounting line;

particle supplying means for supplying electrically charged particles to the plurality of apertures formed on said substrate of said electrode member;

at least one driver IC chip bonded onto the first surface of said substrate at a position between the first mounting line and the first side and connected to said plurality of control electrodes for controlling said plurality of control electrodes independently of one another so that the electrically charged particles selectively travel from said particle supplying means toward the image recording medium while passing through one or more apertures selected from the plurality of apertures;

first supporting means for supporting said electrode member and securing said electrode member to said frame, said first supporting means urging said substrate along the first mounting line, said first supporting means comprising:

a plate-like resilient member provided on the first surface of said substrate along the first mounting line;

a first supporting plate provided on the second surface of said substrate and extending along the first mounting line; and an urging plate provided on said plate-like resilient member such that said plate-like resilient member is sandwiched between said substrate and said urging plate, said urging plate being urged toward said supporting plate; and second supporting means for supporting said electrode member and securing said electrode member to said frame, said second supporting means supporting said electrode member along the second mounting line; wherein said plate-like resilient member prevents wrinkles generated at a time of bonding said driver IC chip onto the first surface of said substrate from spreading to a vicinity of said apertures.

11. An image forming device according to claim 10, wherein said second supporting means comprises an another plate-like resilient member provided on the first surface of substrate along the second mounting line.

12. An image forming device according to claim 11, wherein said second supporting means further comprises an another supporting plate provided on the second surface of said substrate along the second mounting line, and an another urging plate provided on said another plate-like resilient member, said another urging plate being urged against said another supporting plate with said another plate-like resilient member sandwiched between said another urging plate and the substrate.

13. An image forming device according to claim 10, further comprising a biasing member disposed between said first supporting means and said frame to impart a tensile force to said electrode member.

14. An image forming device for forming an image on an image recording medium, comprising:

an electrode member including a substrate and a plurality of control electrodes, the substrate having a surface and being formed with a plurality of apertures in alignment with one another to define an aperture line, the substrate having a first mounting line extending parallel with the aperture line and a second mounting line extending parallel with the aperture line and the first mounting line, the aperture line being positioned between the first mounting line and the second mounting line, said plurality of control electrodes being disposed on the surface with each control electrode provided to a respective aperture;

particle supplying means for supplying electrically charged particles to the plurality of apertures formed on said substrate of said electrode member;

control means for controlling said plurality of control electrodes independently of one another so that the electrically charges particles selectively travel from said particle supplying means toward the image recording medium while passing through the plurality of apertures; and supporting means for supporting said electrode member, the supporting means being attached to the substrate along the first mounting line and the second mounting line;

wherein the surface of said substrate includes an inner region located between the first mounting line and the second mounting line and an outer region located outside the inner region; said plurality of control electrodes extend in the inner region perpendicularly relative to the aperture line without a bent configuration; at least one of said plurality of control electrodes extends in the outer region with a bent configuration; and said plurality of control electrodes are sandwiched between the surface of said substrate and the supporting means attached to the surface along the first mounting line.

15. An image forming device according to claim 14, wherein said electrode member further includes a plurality of driver IC chips mounted on the surface in the outer region, and wherein said plurality of control electrodes extend toward the plurality of IC chips.

16. An image forming device, comprising:

a frame;

an electrode member including a substrate formed with a plurality of apertures in alignment with one another to define an aperture line, and a plurality of control electrodes with each control electrode provided to a respective aperture, wherein said substrate has a side in parallel with the aperture line and a first mounting line in parallel with the aperture line;

particle supplying means for supplying electrically charged particles to the plurality of apertures formed on said substrate of said electrode member;

a resilient member fixedly and directly attached to an entire length of the side of said substrate to be integral with said electrode member, said resilient member having a second mounting line extending in parallel with the aperture line and the first mounting line, wherein the aperture line is disposed between the first mounting line and the second mounting line;

supporting means for supporting said electrode member and the resilient member along the first mounting line and the second mounting line, respectively; and attaching means for attaching said supporting means to said frame to thereby secure said electrode member and the resilient member to said frame; wherein said resilient member prevents said electrode member from being wrinkled.

17. An image forming device according to claim 16, wherein said resilient member blocks wrinkles from spreading to at least one of the apertures.

18. An image forming device according to claim 16, wherein the resilient member is in a form of a single-piece plate-like member formed of a resilient material.

* * * * *